US010959009B2

(12) United States Patent
Patil

(10) Patent No.: US 10,959,009 B2
(45) Date of Patent: Mar. 23, 2021

(54) WEARABLE PERSONAL ACOUSTIC DEVICE HAVING OUTLOUD AND PRIVATE OPERATIONAL MODES

(71) Applicant: Bose Corporation, Framingham, MA (US)

(72) Inventor: Naganagouda B. Patil, Ashland, MA (US)

(73) Assignee: BOSE CORPORATION, Framingham, MA (US)

( * ) Notice: Subject to any disclaimer, the term of this patent is extended or adjusted under 35 U.S.C. 154(b) by 0 days.

(21) Appl. No.: 16/524,523

(22) Filed: Jul. 29, 2019

(65) Prior Publication Data

US 2019/0349666 A1 Nov. 14, 2019

Related U.S. Application Data

(63) Continuation of application No. 15/692,419, filed on Aug. 31, 2017, now Pat. No. 10,412,480.

(51) Int. Cl.
*H04R 1/10* (2006.01)
*H04R 5/033* (2006.01)
(Continued)

(52) U.S. Cl.
CPC ..... *H04R 1/1041* (2013.01); *H04R 1/1016* (2013.01); *H04R 1/1066* (2013.01);
(Continued)

(58) Field of Classification Search
CPC combination set(s) only.
See application file for complete search history.

(56) References Cited

U.S. PATENT DOCUMENTS 3,796,840 A 3/1974 Ohta
4,165,487 A 8/1979 Corderman
(Continued)

FOREIGN PATENT DOCUMENTS

WO 2017058097 A1 4/2017

OTHER PUBLICATIONS

International Search Report and Written Opinion in PCT/US2018/039284 dated Sep. 27, 2018; 15 pages.
(Continued)

*Primary Examiner* — Fan S Tsang
*Assistant Examiner* — Angelica M McKinney
(74) *Attorney, Agent, or Firm* — Schmeiser, Olsen & Watts LLP; William G. Guerin

(57) ABSTRACT

A method of operating an audio system that includes a non-wearable acoustic system and a wearable acoustic device, each having at least one acoustic driver, includes generating, at the at least one acoustic driver of the non-wearable acoustic system, a first acoustic signal having a range of acoustic frequencies. In response to a request of a change of operational mode of the non-wearable acoustic system, a second acoustic signal having a first sub-range of the acoustic frequencies is generated at the at least one acoustic driver of the non-wearable acoustic system and a third acoustic signal having a second sub-range of the acoustic frequencies is generated at the at least one acoustic driver of the wearable acoustic device. The first sub-range of acoustic frequencies is different from the second sub-range of acoustic frequencies and the range of acoustic frequencies is inclusive of the first and second sub-ranges of acoustic frequencies.

20 Claims, 7 Drawing Sheets

(51) Int. Cl.
*H04R 1/24* (2006.01)
*H04R 1/28* (2006.01)
*H04R 3/12* (2006.01)

(52) U.S. Cl.
CPC ..... *H04R 1/1075* (2013.01); *H04R 1/1091* (2013.01); *H04R 1/24* (2013.01); *H04R 1/2857* (2013.01); *H04R 3/12* (2013.01); *H04R 5/0335* (2013.01); *H04R 2201/023* (2013.01); *H04R 2201/028* (2013.01); *H04R 2430/01* (2013.01)

(56) References Cited

U.S. PATENT DOCUMENTS 5,822,440 A 10/1998 Oltman et al.
RE38,405 E 1/2004 Clair, Jr. et al.
6,721,579 B2 4/2004 Liu
7,995,770 B1 8/2011 Simon
8,605,931 B2 12/2013 Amsel
8,938,078 B2 1/2015 Meyer
9,197,978 B2 * 11/2015 Usami ..... H04S 7/30
9,232,366 B1 1/2016 Charlier et al.
9,282,392 B2 3/2016 Ushakov
9,445,213 B2 * 9/2016 Xiang ..... H04S 7/30
9,571,917 B2 2/2017 Litovsky et al.
9,860,645 B1 1/2018 Tsui
9,864,573 B2 1/2018 Tull
9,883,275 B2 1/2018 Ushakov
9,913,016 B2 3/2018 Shin et al.
9,939,146 B1 * 4/2018 Palusky ..... F21V 33/0056
9,961,429 B2 5/2018 Williams et al.
9,985,596 B1 5/2018 Litovsky et al.
10,129,647 B2 11/2018 Seo et al.
10,397,720 B2 8/2019 Audfray et al.
2002/0038158 A1 * 3/2002 Hashimoto ..... H04S 1/002 700/94
2003/0099369 A1 * 5/2003 Cheng ..... H04S 3/00 381/309
2005/0195998 A1 9/2005 Yamamoto et al.
2007/0183617 A1 * 8/2007 Yokota ..... H04R 3/12 381/386
2008/0118078 A1 5/2008 Asada et al.
2008/0166002 A1 * 7/2008 Amsel ..... H04R 5/033 381/370
2009/0076421 A1 3/2009 Grant, Jr.
2009/0274335 A1 11/2009 Cheung et al.
2010/0020998 A1 * 1/2010 Brown ..... H04R 1/1041 381/380
2011/0216931 A1 9/2011 Bui
2012/0076326 A1 * 3/2012 He ..... H04R 3/00 381/120
2013/0256345 A1 10/2013 Larkin
2014/0016803 A1 * 1/2014 Puskarich ..... H04R 29/001 381/309
2015/0264474 A1 9/2015 Seo et al.
2016/0021446 A1 1/2016 Litovsky et al.
2016/0255431 A1 9/2016 Litovsky et al.
2016/0267771 A1 * 9/2016 Baek ..... H04M 1/7253
2016/0286330 A1 * 9/2016 Kofman ..... H04S 7/303
2016/0337750 A1 * 11/2016 Louis ..... H04R 1/403
2016/0366506 A1 12/2016 Kim
2017/0111733 A1 4/2017 Litovsky et al.
2017/0272561 A1 * 9/2017 Kim ..... H04M 1/05
2017/0351483 A1 12/2017 Holdren
2018/0014110 A1 1/2018 Ushakov

OTHER PUBLICATIONS

Non-Final Office Action in U.S. Appl. No. 15/692,419 dated Oct. 30, 2018; 28 pages.
Notice of Allowance in U.S. Appl. No. 15/692,419, dated Apr. 30, 2019; 9 pages.
International Preliminary Report on Patentability in PCT/US2018/039284 dated Mar. 12, 2020; 10 pages.

* cited by examiner

WEARABLE PERSONAL ACOUSTIC DEVICE HAVING OUTLOUD AND PRIVATE OPERATIONAL MODES

RELATED APPLICATIONS

This application is a continuation application and claims the benefit of U.S. patent application Ser. No. 15/692,419 filed Aug. 31, 2017, titled "Wearable Personal Acoustic Device Having Outloud and Private Operational Modes," the contents of which are incorporated by reference herein in their entirety.

BACKGROUND

This disclosure relates to a wearable personal acoustic device and a method of operating an audio system comprising the wearable personal acoustic device. More particularly, the disclosure relates to the generation of acoustic signals from the wearable personal acoustic device according to different operational modes of the device.

SUMMARY

In one aspect, a method of operating an audio system comprising a non-wearable acoustic system and a wearable acoustic device, each having at least one acoustic driver, includes generating, at the at least one acoustic driver of the non-wearable acoustic system, a first acoustic signal having a range of acoustic frequencies. A first change of operational mode of the non-wearable acoustic system is requested. In response to the requesting of the first change of operational mode, a second acoustic signal having a first sub-range of the acoustic frequencies is generated at the at least one acoustic driver of the non-wearable acoustic system and a third acoustic signal having a second sub-range of the acoustic frequencies is generated at the at least one acoustic driver of the wearable acoustic device. The first sub-range of the acoustic frequencies is different from the second sub-range of the acoustic frequencies and the range of acoustic frequencies is inclusive of the first and second sub-ranges of the acoustic frequencies.

Examples may include one or more of the following features:

The first sub-range may include acoustic frequencies that are less or greater than acoustic frequencies included in the second sub-range. The first sub-range and the second sub-range may include overlapping acoustic frequencies.

The at least one acoustic driver of the non-wearable acoustic system may include two acoustic drivers wherein one of the two acoustic drivers generates an acoustic signal having a lower frequency content than the other one of the two acoustic drivers.

The requesting of the first change of operational mode may be automatically generated in response to sensing that the wearable acoustic device is donned by a user or may be automatically generated in response to sensing that the wearable acoustic device is proximate to the non-wearable acoustic system.

The non-wearable acoustic system may be one of a home entertainment system, a home theater system, a home audio systems, or a speaker system.

The method may further include requesting a second change of operational mode of the non-wearable acoustic system. In response to the requesting of the second change of operational mode, the first acoustic signal is generated at the at least one acoustic driver of the non-wearable acoustic system and the third acoustic signal is terminated at the at least one acoustic driver of the wearable acoustic device.

In accordance with another aspect, an audio system includes a non-wearable acoustic system, a wearable acoustic device and a processor. The non-wearable acoustic system has a first acoustic driver and a second acoustic driver. The first acoustic driver is configured to generate a first acoustic signal and the second acoustic driver is configured to generate a second acoustic signal. The first and second acoustic signals together span a range of acoustic frequencies. The first acoustic signal has a first sub-range of the range of acoustic frequencies and the second acoustic signal has a second sub-range of the range of acoustic frequencies different from the first sub-range. The wearable acoustic device has a third acoustic driver. The processor is disposed in the non-wearable acoustic system and is in communication with the first and second acoustic drivers and with the wearable acoustic device. The processor is configured to provide a first drive signal and a second drive signal to the first acoustic driver and the second acoustic driver, respectively, to generate the first acoustic signal and the second acoustic signal, respectively. In response to a request for a change of operational mode of at least one of the non-wearable acoustic system or the wearable acoustic device, the processor is further configured to provide a signal to the wearable acoustic device to generate a third drive signal to be applied to the third acoustic driver to generate a third acoustic signal having a third sub-range of the range of acoustic frequencies.

Examples may include one or more of the following features:

The processor may be further configured to terminate one of the first and second drive signals in response to the request for a change of operational mode. The processor may be configured to communicate with the wearable acoustic device over a wireless link.

The second sub-range and the third sub-range may be the same sub-range. The third sub-range may span the range of acoustic frequencies or may be less than the range of acoustic frequencies.

The request for the change of operational mode may be automatically generated in response to sensing that the wearable acoustic device is donned by a user. The audio system may further include a sensor or a switch in communication with the processor and the request for the change of operational mode may be responsive to a change in a state of the sensor or the switch.

The wearable acoustic device may include a user interface having a button and the request for the change of operational mode may be responsive to a pressing of the button.

The non-wearable acoustic system may be one of a home entertainment system, a home theater system, a home audio systems, or a speaker system.

The wearable acoustic device may be intended to be worn around the neck of a user.

BRIEF DESCRIPTION OF THE DRAWINGS

The above and further advantages of examples of the present inventive concepts may be better understood by referring to the following description in conjunction with the accompanying drawings, in which like numerals indicate like structural elements and features in various figures. The drawings are not necessarily to scale, emphasis instead being placed upon illustrating the principles of features and implementations.

DETAILED DESCRIPTION

Wearable personal acoustic devices, such as those that can be worn on the shoulders or around the neck of the user and which include one or more acoustic drivers located on the device, can produce sound proximate to the ears without blocking ambient sound. Some devices are configured to produce sound at low amplitudes and may be further configured and/or equalized to reduce acoustic spillage that may be bothersome to nearby people. Examples of wearable personal acoustic devices are disclosed in U.S. Pat. No. 9,571,917, titled "Acoustic Device," the disclosure of which is incorporated herein by reference in its entirety, and which describes an acoustic device that is generally "U-shaped" and configured to be worn around the neck.

Figure 1A:
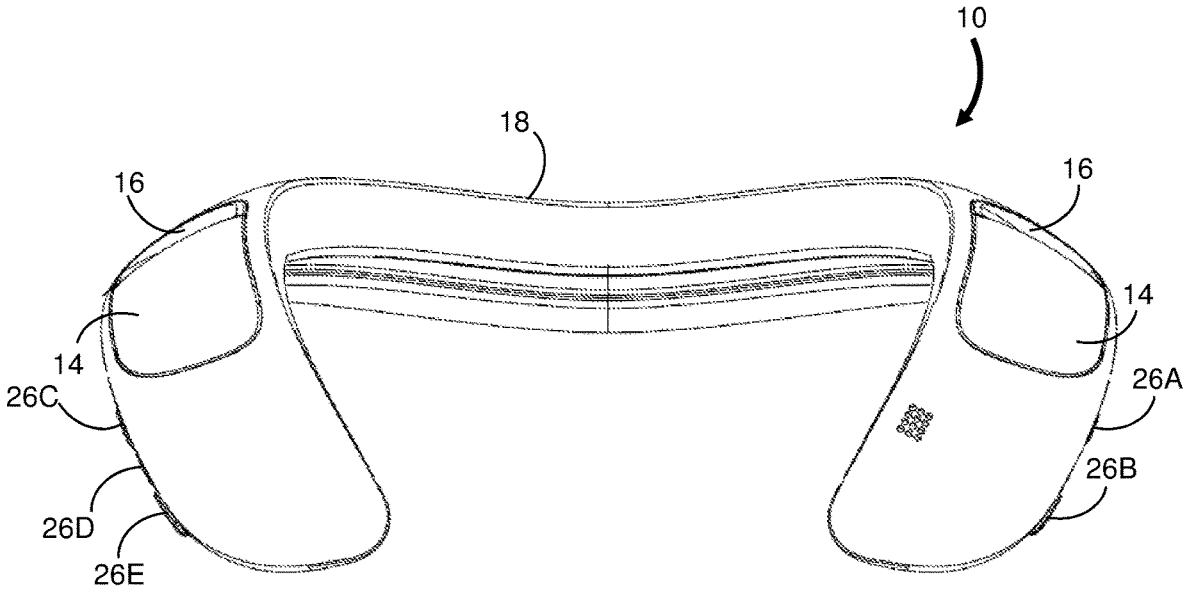
FIG. 1A is a front view of an example of a personal wearable personal acoustic device.
Figure 1B:
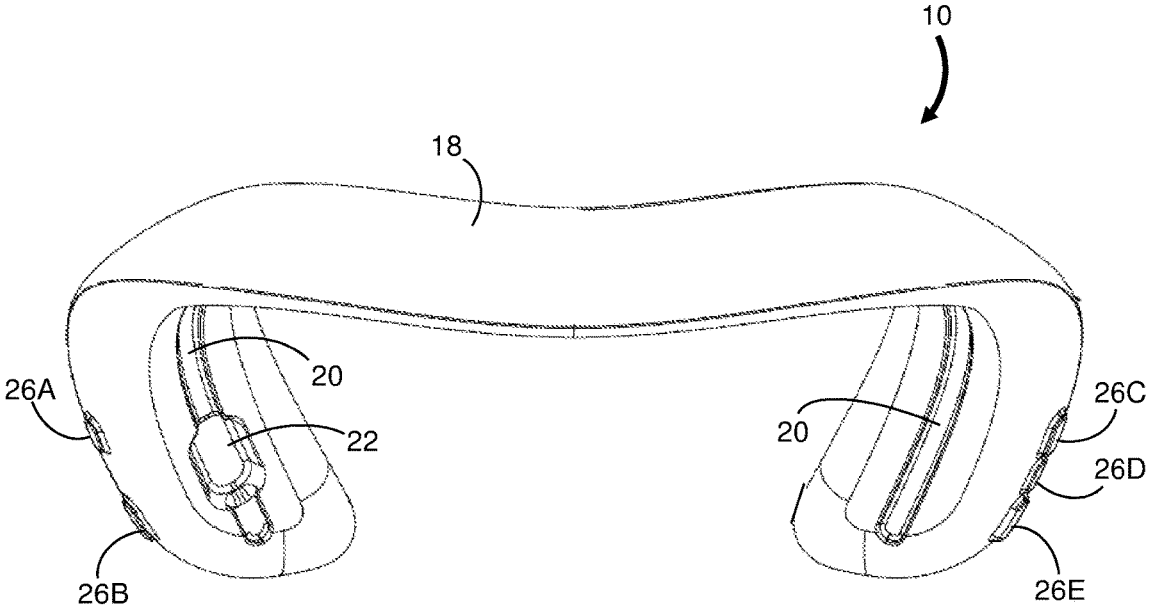
FIG. 1B is a back view of the example of a personal wearable acoustic device shown in FIG. 1A.

FIG. 1A and FIG. 1B show a front view and a back view, respectively, of an example of a personal wearable personal acoustic device 10. The acoustic device 10 directs high quality sound to each ear without the need to position acoustic drivers on, over or in the ears. The acoustic device 10 is configured to be worn around the neck and includes a neckband 18 that includes a housing. The neckband 18 has an approximate "U" shape with two legs that, when worn, extend over or near the clavicles and a curved central portion positioned behind the neck. The illustrated acoustic device 10 may have two acoustic drivers 14; one carried in each leg of the housing. The acoustic drivers 14 are located below the expected locations of the ears of the user and are flush with the outer surface of the housing although in other examples the acoustic drivers 14 may extend outward from the outer surface. The acoustic device 10 also may include two acoustic waveguides inside the housing. Each waveguide may have a sound outlet opening ("exit") 16 below an ear and proximate to one of the acoustic drivers 14. The rear side of one acoustic driver 14 is acoustically coupled to the entrance to one waveguide and the rear side of the other acoustic driver 14 is acoustically coupled to the entrance to the other waveguide. Each waveguide has one end with the acoustic driver that feeds it located below one ear and the other end with the sound outlet opening 16 located below the other ear.

Each ear directly receives acoustic output from the front of one acoustic driver 14 and acoustic output from the back of the other acoustic driver 14 that passes through the adjacent sound outlet opening 16. If the drivers 14 are driven out of phase (e.g., in opposite phase), the two acoustic signals received by each ear are virtually in phase below the fundamental waveguide quarter wave resonance frequency. In a non-limiting example, the fundamental quarter wave resonance for each waveguide may be in a range from about 100 Hz to about 400 Hz. This configuration ensures that low frequency acoustic radiation from each driver 14 and its same side sound outlet opening 16 are in phase and do not cancel each other. Similarly, the radiation from the opposite side driver 14 and its same side sound outlet opening 16 are in phase and do not cancel each other. However, the acoustic radiation from one side is out of phase with respect to the acoustic radiation of the other side, thus providing far field cancellation. This reduces sound spillage from the wearable personal acoustic device 10 to others who are nearby.

While FIGS. 1A and 1B show one example of an acoustic architecture that can be used for the wearable personal acoustic device 10, other acoustic architectures are possible, and may include more or fewer acoustic drivers, waveguides or sound outlet openings than those illustrated.

The neckband 18 may be expanded, straightened, or reshaped to accommodate the comfort of the wearer. The neckband 18 may include a trough 20 and recessed port 22 to receive corresponding features of a closure mechanism on a fabric cover used to enclose the device 10 as described in detail below. Examples of wearable personal acoustic devices having a flexible neckband are disclosed in U.S. patent application Ser. No. 15/041,957, titled "Flexible Waveguide Band," the disclosure of which is incorporated herein by reference in its entirety.

The illustrated device 10 includes user interface features such as buttons 26A to 26E (generally 26) to control operation of the device 10. For example, the buttons 26 may be used to control power and volume, and to select or change an operating mode of the device 10.

Figure 2:
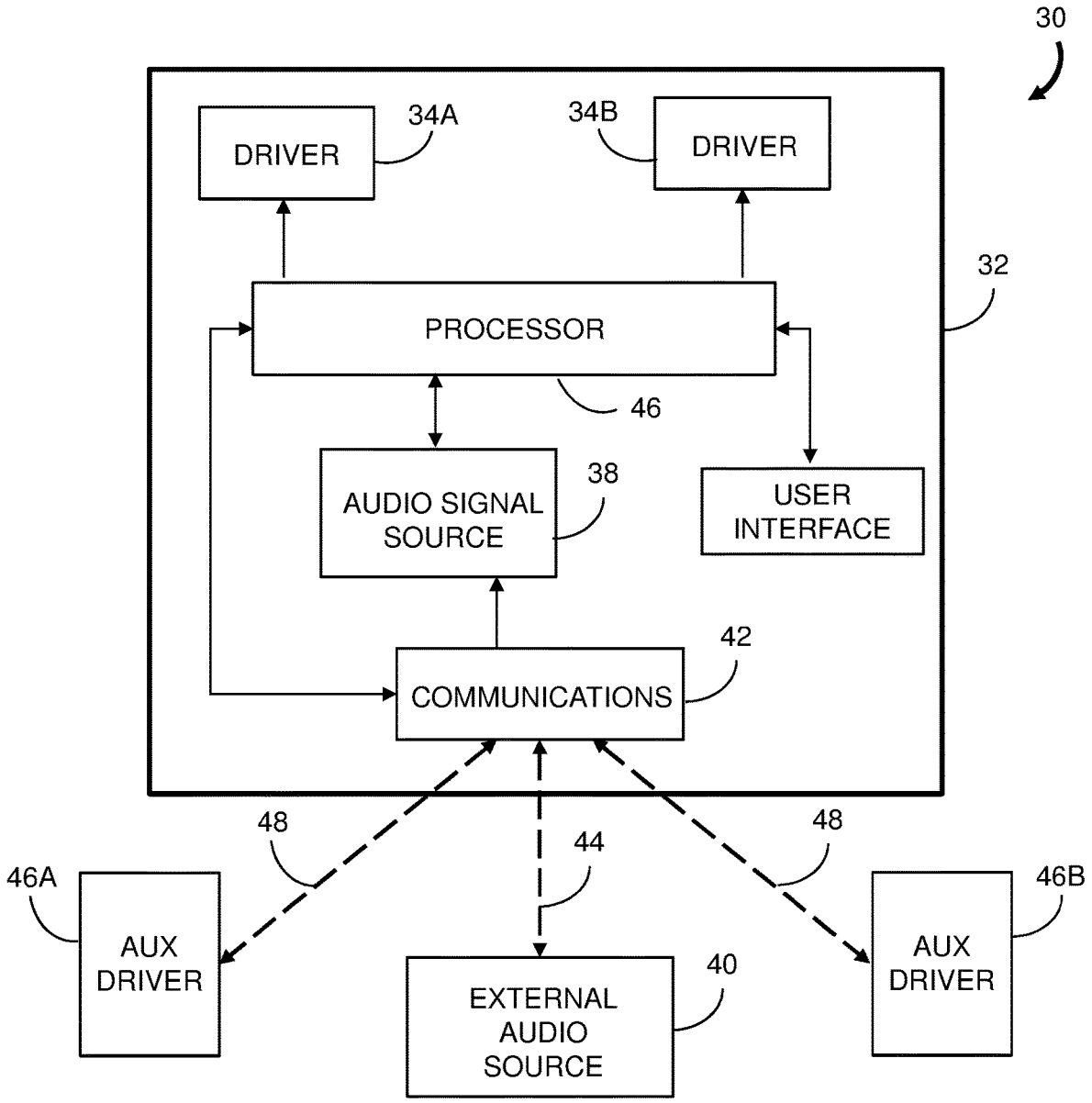
FIG. 2 is a functional block diagram of an example of a personal wearable acoustic device.

FIG. 2 is a functional block diagram of an example of a personal wearable acoustic device 30 that includes a housing 32 and at least two acoustic drivers (transducers) 34A and 34B (generally 34) secured to the housing 32. The device 30 may include one or more rechargeable and/or replaceable batteries (not shown) to provide electrical power to the device 30. An audio signal source 38 provides drive signals to the acoustic drivers 34 under control of a processor 46. As used herein, a drive signal means an electrical signal or other form of signal that is provided to an acoustic driver to cause the driver to generate or emit an acoustic signal. The drive signals can be generated from audio data stored in memory (not shown) and/or or generated from a signal received from an external audio source 40 as is known in the art. By way of a number of non-limiting examples, the external audio source 40 can be a smartphone, a personal computer, a laptop computer or a tablet. The external audio source 40 is configured to communicate with the device 30 through a communications module 42 by wired or wireless link 44 as is known in the art.

In one example of the personal wearable acoustic device 30, the two acoustic drivers 34 are driven out of phase (e.g., at approximately 180° phase difference) with each other, at least at low frequencies. For example, the two acoustic drivers 34 may be driven out of phase with each other at frequencies below approximately 150 Hz. The out of phase operation results in far-field sound cancellation and less acoustic spillage at low audible frequencies. Thus others that are nearby someone that is wearing and operating the device will not hear the low frequencies emitted from the acoustic drivers 34.

Figure 3:
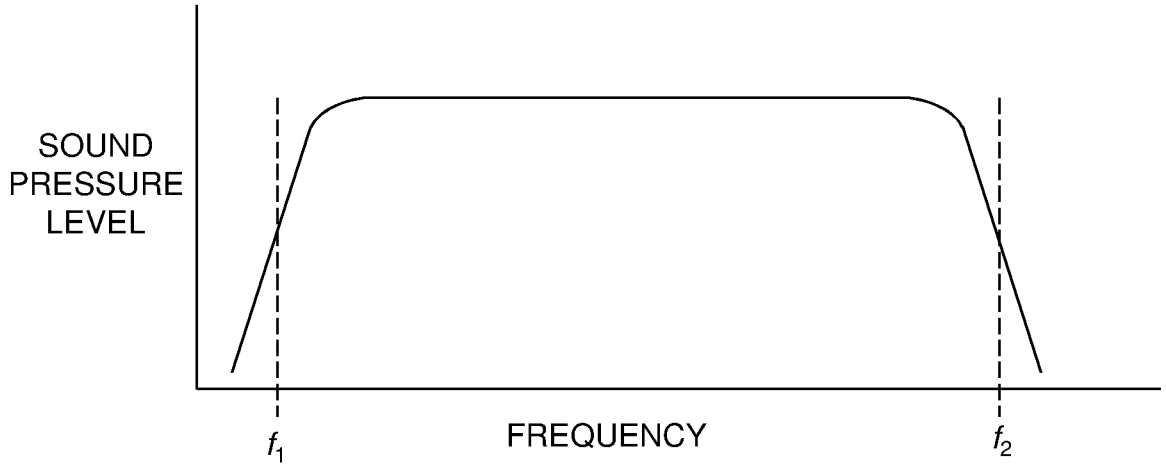
FIG. 3 graphically depicts a range of acoustic frequencies that may be emitted from the device of FIG. 2 while operated in an outloud operational mode.

While the personal wearable acoustic device 30 is worn by a user, the device may be operated in an outloud operational mode. In this mode, the processor 46 provides drive signals to each acoustic driver 34 so that an acoustic signal having a wide range of acoustic frequencies is emitted from each acoustic driver 34 as shown in FIG. 3. For example, the outloud mode of operation can enable the device to generate acoustic signals having significant sound pressure levels (SPL) between frequencies $f_1$ and $f_2$ as shown in FIG. 3. The range of frequencies may span most or all of the audible frequency range (approximately 20 Hz to approximately 20 KHz).

Figure 4:
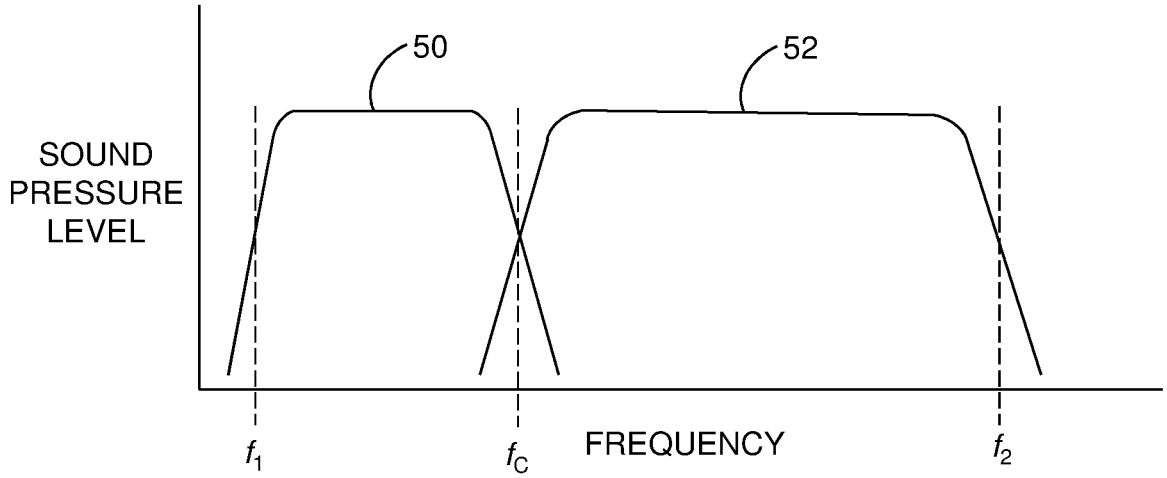
FIG. 4 graphically depicts one range of acoustic frequencies that may be emitted from the device of FIG. 2 and another range of acoustic frequencies that may be emitted from auxiliary acoustic drivers while the device is operated in a private operational mode.

In some instances operating in the outloud mode may present difficulties. For example, the user may be in a crowded environment in which nearby persons may easily hear the sound emitted from the acoustic drivers 34. Even if low audible frequencies are not heard by others due to far-field sound cancellation, the sound at higher audible frequencies may be an annoyance to nearby persons. Advantageously, the personal wearable acoustic device may be operated in a private operational mode. In this mode, the drive signal provided to each acoustic driver 34 results in generation of acoustic signals that have a reduced acoustic frequency range. For example, the sound pressure level of the acoustic signals may have a frequency characteristic that extends from frequency $f_1$ to frequency $f_c$ as shown by plot 50 of FIG. 4. In some examples, the frequency $f_c$ is between about 160 Hz and about 200 Hz. Auxiliary drive signals are provided to auxiliary acoustic drivers 46A and 46B (generally 46). By way of example, the auxiliary drivers 46 may be earphones worn by the user (the earphones may be integral with the personal wearable device, or a separate set of earphones configured to be used with the personal wearable device) or may be acoustic drivers that are located at a remote location with respect to the acoustic drivers 34 of the wearable personal acoustic device. Auxiliary drive signals may be provided to auxiliary acoustic drivers via a wired or wireless connection. Example wireless protocols include Bluetooth, Bluetooth Low Energy (BLE), Near Field Communications (NFC), IEEE 802.11, or other local area network (LAN) or personal area network (PAN) protocols. Plot 52 of FIG. 4 shows an example of the sound pressure level as a function of acoustic frequency for sound emitted from the auxiliary acoustic drivers 46. There may be a range of overlapping acoustic frequencies, at lower frequencies, near the "crossover frequency" $f_c$ that are included in the acoustic signals generated by both the acoustic drivers 34 and the auxiliary acoustic drivers 46 while operating in private mode. The crossover frequency $f_c$ may be in a range from about 150-250 Hz, though other frequencies could be used. It will be recognized that the sound emitted simultaneously from the acoustic drivers 34 and the auxiliary drivers 46 substantially spans a frequency range extending from frequency $f_1$ to frequency $f_2$. This frequency range may include the entire audible frequency range.

Advantageously, the sound emitted from the acoustic drivers 34 is substantially cancelled in the far-field and therefore may not easily be heard by anyone other than the user. If the auxiliary drivers 46 are earphones located in or about the ears of the user (e.g. earbuds), the sound emitted from the earphones is similarly not easily heard by nearby persons. The earphones are configured to avoid acoustically sealing the ear canals so that the lower frequencies emitted from the acoustic drivers 34 are heard by the user both conductively and through the ear canals.

Thus, the wearable personal acoustic device is well-adapted for both isolated environments and crowded environments when used with auxiliary earphones. In isolated environments when the user is alone or others are not close by, the outloud mode of operation enables the user to hear the full range of acoustic frequencies directly from the device 30. In crowded environments, such as public transportation and sidewalks where numerous people may be present, the private mode of operation enables the user to hear the higher acoustic frequencies in the acoustic signals from the earphones 46 and the lower acoustic frequencies from the acoustic drivers 34 in the device 30. The private mode of operation has a significant advantage over other systems having dual modes of operation in which acoustic signals are generated by either acoustic drivers in the device or by earphones, but not both. Such systems require larger earphones to generate the bass portion of the acoustic spectrum while the earphones are supplying the acoustic signals to the user. In addition, larger earphones generally consume more electrical power. By contrast, the earphones in the present disclosure may be much smaller than conventional earphones, as they may be purposed for specifically reproducing only higher frequency audio.

In the various examples below, methods of operating an audio system comprising a wearable personal acoustic device having one or more acoustic drivers are described. The methods include changing an operational mode of the device, either manually or automatically. The audio system further includes one or more auxiliary acoustic drivers. For example, the auxiliary drivers may be a pair of headphones. The headphones may be of various form factors, including in-ear, on-ear, or around-ear and may be wired or wireless. The headphones may be integral with the personal acoustic device. That is, they may be tethered or otherwise docked within the personal acoustic device when not in use. Alternatively, the headphones may be stand-alone headphones that are configured to be used with the personal acoustic device. In other examples, the one or more auxiliary drivers may be components of a home entertainment system or home theater system. It will be recognized that the examples of methods described herein may also be implemented using an audio system that includes the personal wearable acoustic device and any separate system having at least one auxiliary acoustic driver.

Figure 5:
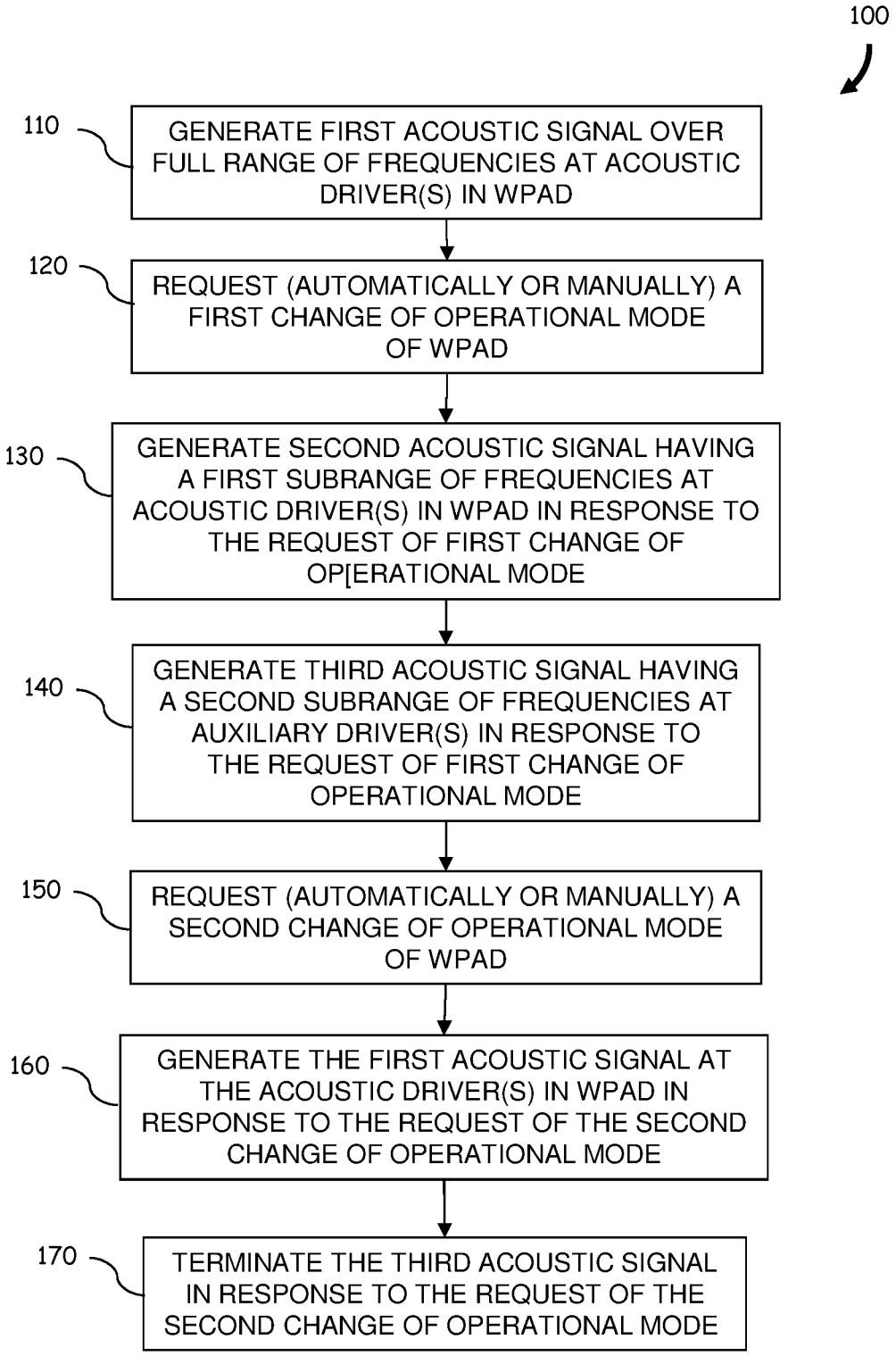
FIG. 5 is a flowchart representation of an example of a method of operating an audio system comprising at least one auxiliary driver and a wearable personal acoustic device.

FIG. 5 is a flowchart representation of an example of a method 100 of operating an audio system comprising at least one auxiliary driver and a wearable personal acoustic device (WPAD) that includes at least one acoustic driver. Reference is also made to schematic block diagrams FIGS. 6 and 7 which show an audio system 60 that includes a pair of auxiliary acoustic drivers (earphones) 68A and 68B (generally 68) and a wearable personal acoustic device 62 having a pair of acoustic drivers 66A and 66B (generally 66).

Figure 6:
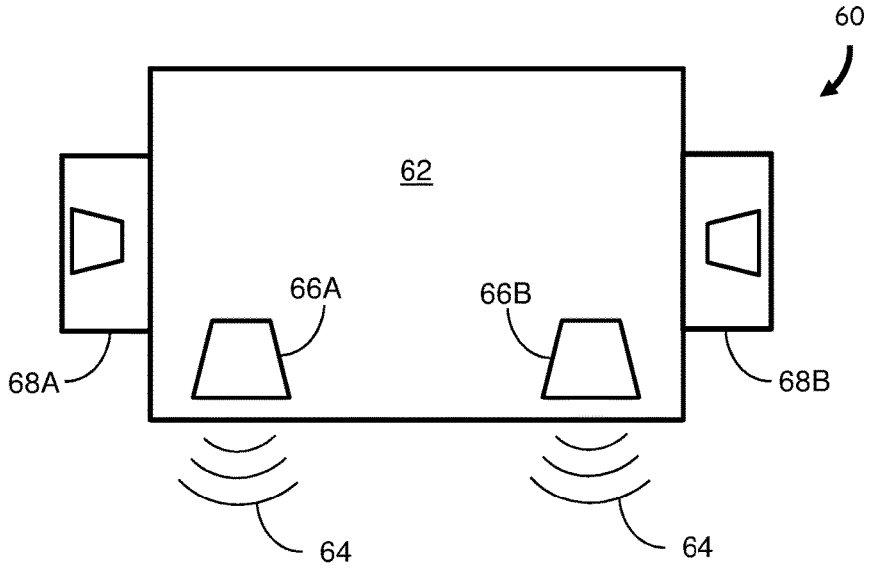
FIG. 6 is a block diagram showing an example of how a wearable personal acoustic device operates while in an outloud operational mode.

FIG. 6 shows an example of how the wearable personal acoustic device 62 operates while in an outloud operational mode. The device 62 generates (110) an acoustic signal 64 at each of the acoustic drivers 66 while a pair of earphones 68 remain unused and docked to the housing of the device 62 (or if the earphones are a separate pair of earphones, remain unused and stowed elsewhere). The acoustic signals 64 have a broad range of acoustic frequencies (see FIG. 3). For example, the range of acoustic frequencies may span most or all of a full range of audible frequencies.

A first change of operational mode of the device is requested (120), for example, when the user enters a public space where others are present and in which the private operational mode is preferred to avoid disturbing others. The request may be generated automatically, for example, by removing ("undocking") earphones 68 that are attached ("docked") to the housing of the device 62. Removing the earphones 68 may cause a sensor (e.g. a proximity sensor or contact sensor) on the device 62 or on the earphones 68 to trigger a signal to indicate the removal. Alternatively, the request may be generated manually by pressing a button on the device 62 or activating a corresponding button on a user interface of a connected device, such as a smartphone or tablet. In one example, the request is generated as a result of activation of a switch disposed at or near the location of at least one of the earphones 68 as the earphone 68 is undocked from the device 62. The switch may be a mechanical switch that changes position upon removal of the earphone 68. Alternatively, the switch may be a sensor such as a capacitive, optical sensor, or motion sensor (e.g., accelerometer or gyroscope) that changes a state of a sensor signal upon removal of the earphone 68 or placement of the earphone in or near a user's ear.

It should be recognized that the earphones 68 are not required to be dockable with the housing of the device 62. For example, the earphones 68 may be items that are acquired independent of the device 62 and/or may not be adapted for attachment to the device 62 as long as the earphones 68 are capable of communication with the device 62 (or a separate, connected device, such as a smartphone or tablet) through a wired or wireless communications link (e.g., see wireless links 48 in FIG. 2). Where the earphones 68 are dockable with the housing of the device 62, the earphones 68 may be configured so that they are charging while docked.

Figure 7:
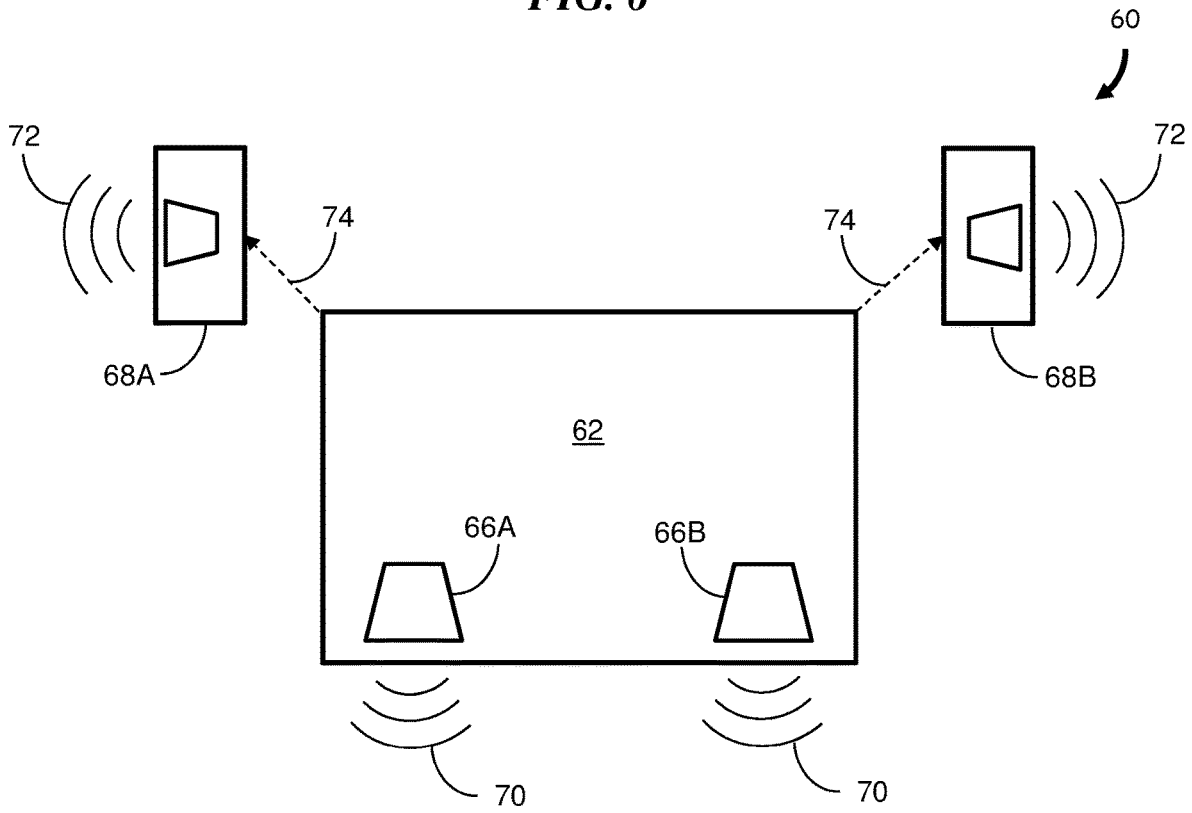
FIG. 7 is a block diagram showing an example of how a wearable personal acoustic device operates while in a private operational mode.

In response to the request of the change in operational mode, a second acoustic signal 70 is generated (130) at the acoustic drivers 66 and a third acoustic signal 72 is generated (140) at the earphones 68, as depicted in FIG. 7. The third acoustic signal 72 may be generated in response to a drive signal transmitted from the device 62 to the earphones 68 along a wired or wireless link 74 as is known in the art. The second acoustic signal 70 has a first subrange of acoustic frequencies (e.g., 50 in FIG. 4). The third acoustic signal 72 has a second subrange of frequencies (e.g., 52 in FIG. 4). The control signals for generating the second and third acoustic signals may be generated on-board the personal acoustic device (e.g., by processor 46 of FIG. 2) or may be generated by a processor on a separate, connected device (e.g., a smartphone or tablet). Thus, as described above, the change in operational mode allows the full audio content to be provided to the user from two separate pairs of acoustic drivers in a manner that prevents significant acoustic spillage to others near to the user.

The method 100 may continue by requesting (150) a second change to the operational mode of the device 62. The request may be made as a result of the user moving from a public environment to a private environment where the user wishes to change to the outloud mode. As before, the request may be manually or automatically generated. In one example, the earphones 68 are returned to their docked position in the housing of the device 62. In response to the request of the second change in operational mode, the first acoustic signal 64 is generated (160) at the acoustic drivers 66 of the device 62 and the third acoustic signal 72 at the earphones 68 is terminated (170). Thus, the audio system 60 returns to the operational mode depicted in FIG. 6.

It will be recognized that variations of the method 100 of FIG. 5 may be performed. For example, the method 100 may be limited to performing steps 110 to 140, corresponding to changing from an outloud operational mode to a private operational mode. Conversely, the method 100 may be limited to performing steps 130 to 170, corresponding to changing from the private operational mode to the outloud operational mode.

In another example of a method of operating an audio system comprising at least one auxiliary driver and a wearable personal acoustic device that includes at least one acoustic driver, the method includes substantially the same steps as those described above with respect to FIG. 5; however, the second acoustic signal 70 at one of the acoustic drivers 66A of the wearable personal acoustic device 62 has a phase that is substantially opposite to a phase of the second acoustic signal 70 at the other acoustic driver 66B. This enables the far-field noise cancellation described above that is particularly desirable when in the private operational mode.

Figure 8:
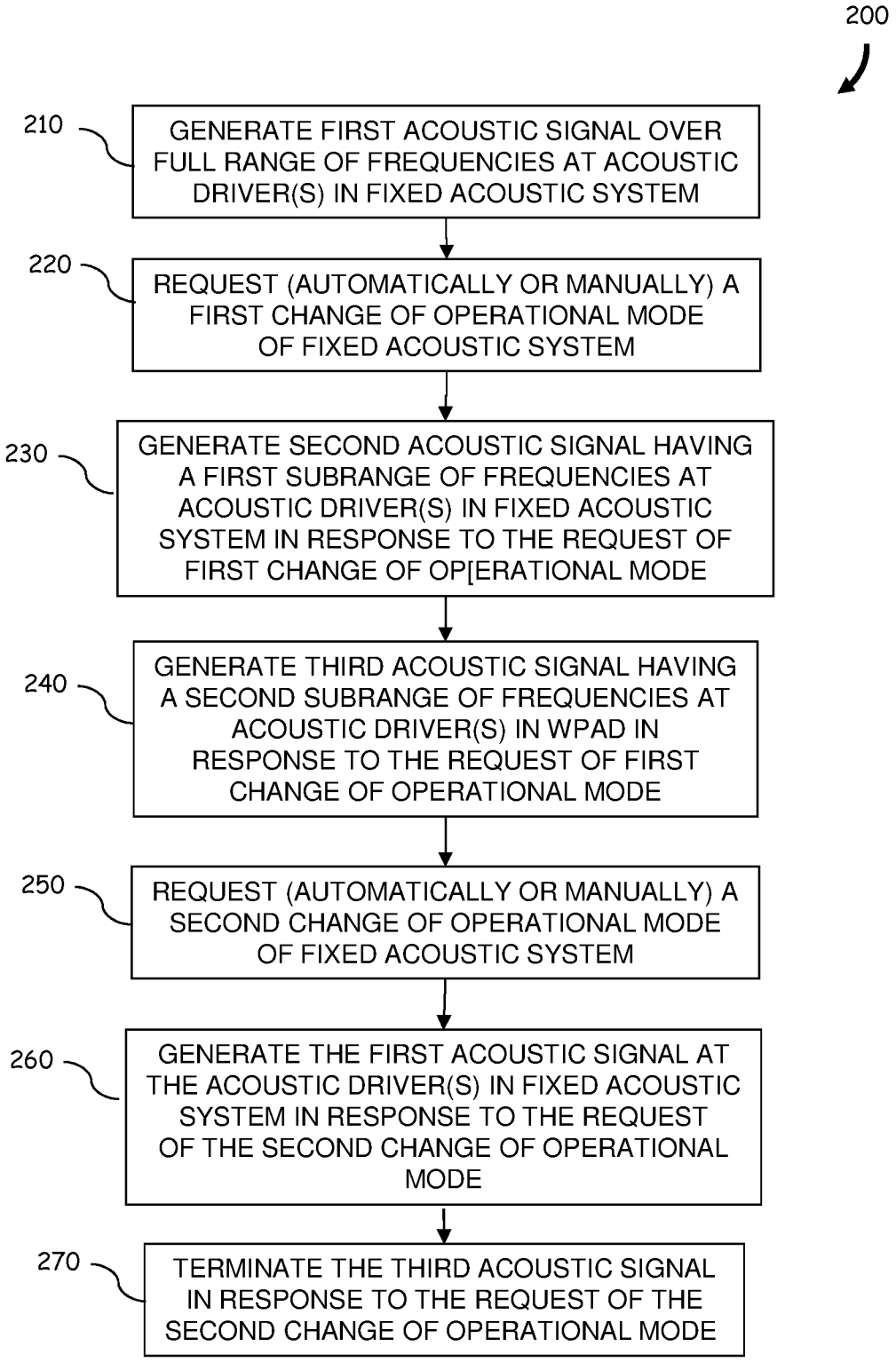
FIG. 8 is a flowchart representation of an example of a method of operating an audio system comprising at least one auxiliary driver and a wearable personal acoustic device in which the audio system includes a fixed acoustic system.

FIG. 8 is a flowchart representation of another example of the method 200 in which the audio system includes a non-wearable acoustic system, such as a fixed acoustic system, and the wearable personal acoustic device (WPAD). As used herein, a non-wearable acoustic system includes an acoustic system that is not worn by a user and, in some instances, remains fixed at a location after installation. By way of non-limiting examples, non-wearable acoustic systems include home entertainment systems, home theater systems and home audio systems, and may also include stand-alone speakers. Reference is also made to the schematic block diagrams of FIGS. 9 and 10 which show an audio system 80 that includes a fixed acoustic system 82 and a wearable personal acoustic device 84.

The fixed acoustic system 82 in the illustrated example includes acoustic drivers 86A and 86B (generally 86) configured to emit acoustic signals having lower (e.g., bass) frequencies in the audio content. The system 82 further includes acoustic drivers 88A and 88B (generally 88) configured to emit acoustic signals having higher frequencies (e.g., mid-range and greater) in the audio content. The personal wearable acoustic device 84 may be similar to the device shown in FIG. 2 and includes two acoustic drivers 90A and 90B (generally 90). In this example, the fixed acoustic system 82 is the source of the full audio content and the acoustic drivers 90 in the wearable personal acoustic device 84 may play either a sub-range or the full range of the acoustic frequencies of the audio content.

Figure 9:
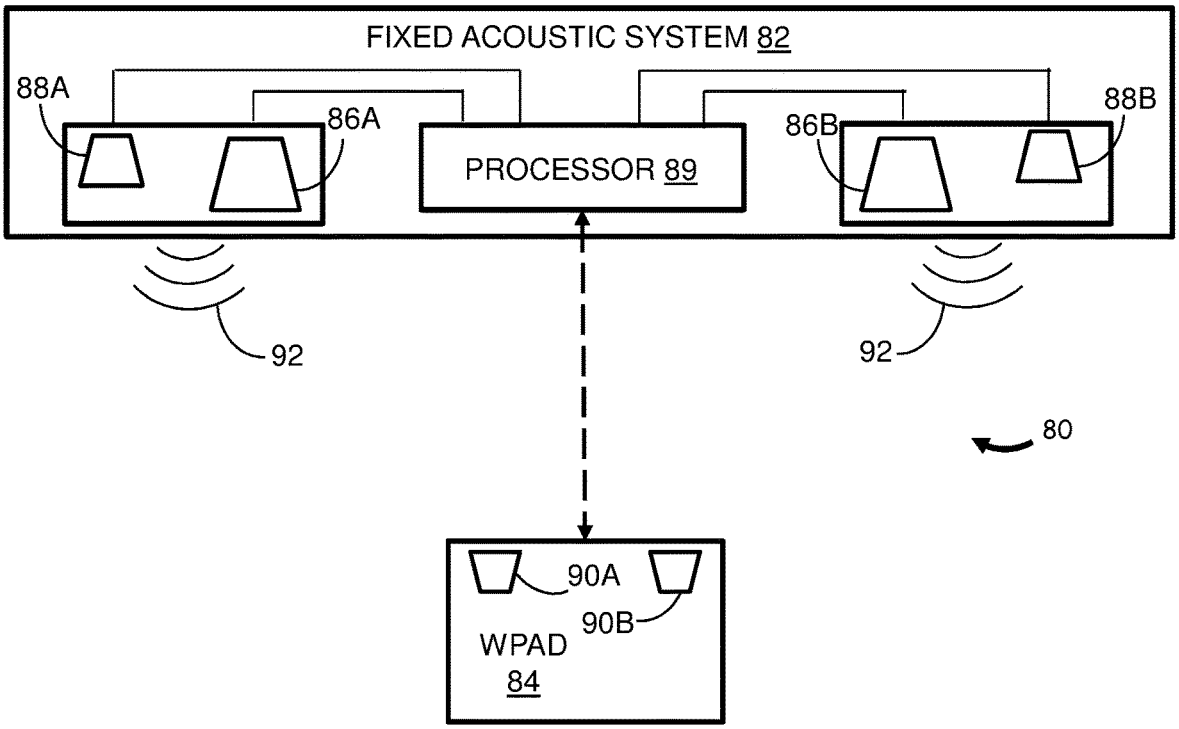
FIG. 9 is a block diagram showing an example of how an audio system operates while in a first operational mode.

In the example of operation depicted in FIG. 9, the fixed acoustic system 82 generates (210) a first acoustic signal 92 that includes a full range of frequencies (see FIG. 3) in the audio content with a lower frequency portion of the range emitted by acoustic drivers 86 and a higher frequency portion of the range emitted by acoustic drivers 88.

A first change of operational mode of the fixed acoustic system is requested (220) either automatically or manually. For example, the personal wearable acoustic device 84 may have one or more sensors used to sense when the device 84 is donned by a user to cause the request to be automatically generated. Alternatively, the device 84 may have a switch that changes state when the device 84 is donned. In addition or in the alternative, the device 84 and/or the fixed acoustic system 82 may have one or more sensors used to determine when the device 84 is in proximity to the fixed acoustic system 72 (e.g., via infrared sensors, through the use of sub-acoustic signals, etc.) to cause the request to be automatically generated. The request may be generated manually, for example, by pressing a button on the device 84 or activating a button on a user interface of the fixed acoustic system 82 or on a connected device, such as a smartphone or tablet. The smartphone or tablet may be connected to one or both of device 84 and fixed acoustic system 82.

Figure 10:
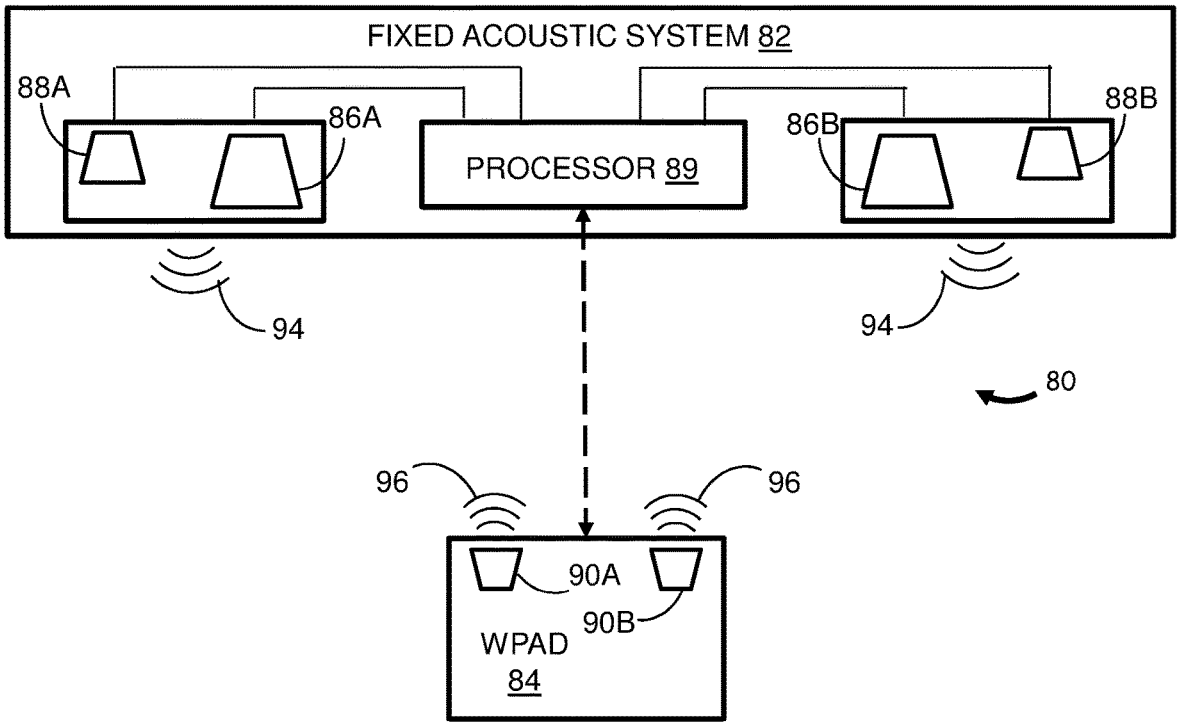
FIG. 10 is a block diagram showing an example of how the audio system of FIG. 9 operates while in a second operational mode.

FIG. 10 depicts operation of the audio system in the changed operational mode. In response to the request, a second acoustic signal 94 having a first subrange of frequencies is generated (230) at the fixed acoustic system 82. For example, the drive signals provided to the acoustic drivers 86 and 88 may have modified frequency content. Alternatively, one set of the acoustic drivers 86 or 88 may be disabled to prevent emitting an acoustic signal. For example, it may be desirable to disable the lower frequency acoustic drivers 86 so as not to disturb others present in nearby rooms and thereby only emit acoustic signals having higher frequency content (e.g., 52 in FIG. 4) from acoustic drivers 88. In further response to the request, a third acoustic signal 96 having a second subrange of frequencies is generated (240) at the acoustic drivers 90 in the personal wearable acoustic device 84. For example, the mode of operation may correspond to the private mode described above in which only lower frequencies (e.g., 50 in FIG. 4) are emitted from the device 84, while higher frequency content is emitted by the fixed acoustic system 82. This mode may be used, for example, to reduce disturbance or annoyance from low frequency content to others present in nearby rooms. If the acoustic drivers 90 are driven substantially out of phase with respect to each other, there is far-field sound cancellation so that there is less acoustic spillage at lower audible frequencies. The control signals for generating the second and third acoustic signals may be generated by a processor in in the wearable personal acoustic device, the processor 89 in the fixed acoustic system or a processor in a separate, connected device such as a smartphone or tablet. In other examples, only higher frequencies are emitted from the device 84, while lower frequency content is emitted by the fixed acoustic system 82. This mode may be used, for example, to improve audibility of human speech or voice sounds, which for some people may be otherwise difficult to hear solely from the fixed acoustic system 82. Outputting some content through the wearable personal acoustic device 84 and other content through the fixed acoustic system 82 also enables independent volume control of that content, so it can be played at a volume appropriate for the user and so as to not disturb others present in nearby rooms.

The method 200 may continue by requesting (250), either automatically or manually, a second change of operation mode of the fixed acoustic system 82. For example, the request may be issued to return to the original operational mode prior to the first change. In response to the second request to change the operational mode, the first acoustic signal is generated (260) at the acoustic drivers 86 and 88 of the fixed acoustic system 82 and the third acoustic signal is terminated (270).

Variations of the method 200 may be performed. For example, the method 200 may be limited to performing steps 210 to 240 for a single change of operational mode. Conversely, the method 200 may be limited to performing steps 230 to 270, corresponding to a single (reverse) change in operational mode.

It should be recognized that the fixed acoustic system may include any number of acoustic drivers. In one example, the fixed acoustic system may have only a single acoustic driver (or a single pair of acoustic drivers) for which the single driver (or pair of drivers) emits the full range acoustic signal for the system. In other examples, the fixed acoustic system includes a plurality of acoustic drivers, or a plurality of pairs of acoustic drivers (FIGS. 9 and 10 show two pairs). In a specific example, the fixed acoustic system may have a pair of bass acoustic drivers, a pair of mid-range acoustic drivers and a pair of high frequency (e.g., tweeter) acoustic drivers. In examples having acoustic drivers emitting acoustic signals having different frequency content, the modification in the frequencies emitted from the fixed acoustic system according to the change in operational mode can be achieved by changing the frequency content of the drive signals provided to the acoustic drivers and/or changing the number of acoustic drivers actively emitting acoustic signals.

A number of implementations have been described. Nevertheless, it will be understood that the foregoing description is intended to illustrate, and not to limit, the scope of the inventive concepts which are defined by the scope of the claims. Other examples are within the scope of the following claims.

What is claimed is:

1. A method of operating an audio system comprising a non-wearable acoustic system and a wearable acoustic device, the non-wearable acoustic system having at least one acoustic driver, the wearable acoustic device having at least one acoustic driver, the method comprising:

generating, at the at least one acoustic driver of the non-wearable acoustic system, a first acoustic signal having a range of acoustic frequencies;

requesting a first change of operational mode of the non-wearable acoustic system;

generating, at the at least one acoustic driver of the non-wearable acoustic system, a second acoustic signal having a first sub-range of the acoustic frequencies in response to the requesting of the first change of operational mode; and generating, at the at least one acoustic driver of the wearable acoustic device, a third acoustic signal having a second sub-range of the acoustic frequencies in response to the requesting of the first change of operational mode, wherein the first sub-range of the acoustic frequencies is different from the second sub-range of the acoustic frequencies and wherein the range of acoustic frequencies is inclusive of the first and second sub-ranges of the acoustic frequencies.

2. The method of claim 1 wherein the first sub-range comprises acoustic frequencies that are less than acoustic frequencies included in the second sub-range.

3. The method of claim 1 wherein the first sub-range comprises acoustic frequencies that are greater than acoustic frequencies included in the second sub-range.

4. The method of claim 1 wherein the first sub-range and the second sub-range include overlapping acoustic frequencies.

5. The method of claim 1 wherein the at least one acoustic driver of the non-wearable acoustic system comprises two acoustic drivers wherein one of the two acoustic drivers generates an acoustic signal having a lower frequency content than the other one of the two acoustic drivers.

6. The method of claim 1 wherein the requesting of the first change of operational mode is automatically generated in response to sensing that the wearable acoustic device is donned by a user.

7. The method of claim 1 wherein the requesting of the first change of operational mode is automatically generated in response to sensing that the wearable acoustic device is proximate to the non-wearable acoustic system.

8. The method of claim 1 wherein the non-wearable acoustic system is one of a home entertainment system, a home theater system, a home audio systems, or a speaker system.

9. The method of claim 1 further comprising:

requesting a second change of operational mode of the non-wearable acoustic system;

generating, at the at least one acoustic driver of the non-wearable acoustic system, the first acoustic signal in response to the requesting of the second change of operational mode; and terminating, at the at least one acoustic driver of the wearable acoustic device, the third acoustic signal in response to the requesting of the second change of operational mode.

10. An audio system, comprising:

a non-wearable acoustic system having a first acoustic driver and a second acoustic driver, the first acoustic driver configured to generate a first acoustic signal and the second acoustic driver configured to generate a second acoustic signal, wherein the first and second acoustic signals together span a range of acoustic frequencies, the first acoustic signal having a first sub-range of the range of acoustic frequencies and the second acoustic signal having a second sub-range of the range of acoustic frequencies different from the first sub-range;

a wearable acoustic device having a third acoustic driver; and a processor disposed in the non-wearable acoustic system and being in communication with the first and second acoustic drivers and with the wearable acoustic device, wherein the processor is configured to:

provide a first drive signal and a second drive signal to the first acoustic driver and the second acoustic driver, respectively, to generate the first acoustic signal and the second acoustic signal, respectively; and in response to a request for a change of operational mode of at least one of the non-wearable acoustic system or the wearable acoustic device, provide a signal to the wearable acoustic device to generate a third drive signal to be applied to the third acoustic driver to generate a third acoustic signal having a third sub-range of the range of acoustic frequencies.

11. The audio system of claim 10 wherein the processor is further configured to terminate one of the first and second drive signals in response to the request for a change of operational mode.

12. The audio system of claim 10 wherein the second sub-range and the third sub-range are the same sub-range.

13. The audio system of claim 10 wherein the request for the change of operational mode is automatically generated in response to sensing that the wearable acoustic device is donned by a user.

14. The audio system of claim 13 further comprising one of a sensor and a switch in communication with the processor and wherein the request for the change of operational mode is responsive to a change in a state of the sensor or the switch.

15. The audio system of claim 10 wherein the wearable acoustic device includes a user interface having a button and wherein the request for the change of operational mode is responsive to a pressing of the button.

16. The audio system of claim 10 wherein the non-wearable acoustic system is one of a home entertainment system, a home theater system, a home audio systems, or a speaker system.

17. The audio system of claim 10 wherein the processor is configured to communicate with the wearable acoustic device over a wireless link.

18. The audio system of claim 10, wherein the third sub-range spans the range of acoustic frequencies.

19. The audio system of claim 10, wherein the third sub-range is less than the range of acoustic frequencies.

20. The audio system of claim 10, wherein the wearable acoustic device is intended to be worn around the neck of a user.

* * * * *